US006485159B2

(12) United States Patent
Pitts

(10) Patent No.: US 6,485,159 B2
(45) **Date of Patent: *Nov. 26, 2002**

(54) RECEPTACLES AND CONTAINERS HAVING LUMINOSITY FOR NON-LIGHTED AND EMERGENCY CONDITIONS

(76) Inventor: Algerome Pitts, 56 Freeman St., Newark, NJ (US) 07105

( * ) Notice: Subject to any disclaimer, the term of this patent is extended or adjusted under 35 U.S.C. 154(b) by 0 days.

This patent is subject to a terminal disclaimer.

(21) Appl. No.: 09/775,892

(22) Filed: Feb. 3, 2001

(65) Prior Publication Data

US 2001/0028561 A1 Oct. 11, 2001

Related U.S. Application Data

(63) Continuation-in-part of application No. 09/256,027, filed on Feb. 23, 1999, now Pat. No. 6,186,634.

(51) Int. Cl.[7] ..... F21V 9/16
(52) U.S. Cl. ..... 362/84; 362/208
(58) Field of Search ..... 362/84, 34, 101, 362/125, 154, 209, 208

(56) References Cited

U.S. PATENT DOCUMENTS 4,901,664 A * 2/1990 Labrecque ..... 116/210
5,007,647 A * 4/1991 Gulick ..... 264/132
5,672,937 A * 9/1997 Choi et al. ..... 313/503
6,186,634 B1 * 2/2001 Pitts ..... 362/208
6,247,995 B1 * 6/2001 Bryan ..... 124/74

FOREIGN PATENT DOCUMENTS

JP 409300498 A * 11/1997

* cited by examiner

*Primary Examiner*—Sandra O'Shea
*Assistant Examiner*—Hargobind S. Sawhney

(57) ABSTRACT

A container or receptacle having luminosity for emergency or non-lighted conditions to illuminate the surfaces of such containers or receptacles in which to give them visibility in the absence of any light source. The container includes an upper lid section and a lower retaining section having an interior compartment for holding of materials, goods, products, tools, medical equipment or medicine therein. The upper lid section includes interior lid wall surfaces and exterior lid wall surfaces, and the lower retaining section includes interior retaining wall surfaces and exterior retaining wall surfaces. The interior lid wall surfaces and/or the exterior lid surfaces includes a luminescent coating thereon for providing luminosity and for affording visibility to the upper lid section in the absence of any other light source. The interior retaining wall surfaces and/or the exterior retaining wall surfaces includes a luminescent coating thereon for providing luminosity and for affording visibility to the lower retaining section in the absence of any other light source. The luminescent coating includes protective covering means for allowing an increased visibility of the luminescent coating, and for giving resistance to wear and impact of the luminescent coating on the wall surfaces of the container.

17 Claims, 10 Drawing Sheets

RECEPTACLES AND CONTAINERS HAVING LUMINOSITY FOR NON-LIGHTED AND EMERGENCY CONDITIONS

RELATED APPLICATION

This is a continuation-in-part of application Ser. No. 09/256,027, filed on Feb. 23, 1999 now U.S. Pat. No. 6,186,634.

FIELD OF THE INVENTION

This invention relates to a holder, canister, container, receptacle, box or kit having luminosity for emergency or non-lighted conditions in which to illuminate the outer surfaces of such containers, and give them visibility in the absence of any light source. More particularly, luminescent containers such as first-aid kits, survival containers, tool boxes, security boxes and the like, in which the chemiluminescent coating on its outer surfaces and handles gives the user a source of visible light in order for the user to have access to those items in the absence of any light source during emergency conditions.

BACKGROUND OF THE INVENTION

Frequently, many types of emergency conditions and situations are experienced in homes, offices, stores, industrial plant facilities and commercial establishments involving power failures where an interior or exterior area has no visible light. These power failures may be caused by electrical short circuits, fire, accidents, brown-outs, black-outs, natural disasters (such as hurricanes, tornadoes, floods, typhoons, tidal surges, etc.) or a planned shutdown or shut-off of electricity to a residential dwelling or commercial facility. As a result of these emergencies, most facilities, and especially residential homes, do not have emergency generators, or only emergency light sources (such as lanterns, flash lights, etc.) to provide visible lighting for leaving or entering such buildings during these emergency conditions.

First-aid kits, tool boxes, flashlight holders, survival rations, food containers having light reflectors, reflective tape; reflective paint thereon are commonly used to locate these receptacles for normal or emergency situations involving power failures, fires, smog, earthquakes and the like, where interior or exterior areas have a minimum or complete to absence of light. These containers/holder, etc. are typically stored on shelves, walls, or on cabinets to facilitate their locations.

Many types of materials are known to help reflect light or transmit light, these include reflective metallic materials, reflective paints and chemiluminescent materials. Most of the aforementioned materials will only function in the presence of some light.

There remains a need for boxes, containers, holders, kits, receptacles and the like having luminosity for use in a variety of emergency type items, products or devices for providing a visible light source in the absence of any light during an emergency non-lighted condition in order to provide automatic and natural illumination to an area when a power failure occurs. Examples of such hardware and emergency-type products can be in the form of first-aid kits, survival food containers, flashlight holders, tool boxes, gasoline containers, kerosine lanterns, canteens, portable water holders, generators, propane canisters/lanterns and the like.

DESCRIPTION OF THE PRIOR ART

Luminescent articles and devices such as indicators, containers, bottles, labels, clipboards, lamp shades, aerodynamic discs and duplicating devices of various configurations, structures and materials of construction have been disclosed in the prior art. For example, U.S. Pat. No. 4,401,050 to BRITT et al discloses a phosphorescent escape route indicator having at least one protruding indicia formed within or attached to a sheet of material. The protruding indicia has incorporated therewith a phosphorescent substance capable of emitting a glow in the absence of light. An adhesive formed as part of the sheet is utilized to apply the indicator to the surface of walls or stairways thereby aiding in delineating escape route or access routes to emergency equipment during time of emergency. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 4,708,817 to DUDNICK discloses a container having a latent message on the container's surface is coated with a luminescent, phosphorescent and/or fluorescent material, such that the warning message glows and is clearly discernible in the dark. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 4,943,896 to JOHNSON discloses a method of producing improved infant care articles, such as baby bottle assemblies, characterized by the inclusion of a non-toxic, non-irritating phosphorescent material with the material of construction of components of the infant care articles so that such components phosphorescently emit light visible in a darkened environment, allowing the location and position of the articles to be readily determined without the need for an additional light source. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 5,007,647 to GLUCK discloses a luminescent golf ball including a distinct luminescent coating formed and adhered to the entire outer curved surface, the luminescent coating is made from a luminescent chemical material in different colors being white, red, yellow or green, and has a clear and transparent shell protecting the luminescent coating. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 5,172,937 to SACHETTI discloses structures, such as labels on beer bottles having fluorescent and phosphorescent materials that emit and reflect light to provide a sense of identity to the beer bottle. The label is in the form of a blanket that has a protective grid of phosphorescent material thereon, such that when the phosphorescent material is exposed to light and placed in a dark environment the beer bottle label emits light for a period time. The protective grid is a pattern of intersecting ribbons of phosphorescent material anchored to and covering substantially one surface of the label. The protective grid provides a visual light shield that creates an image of identification for that label. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 5,502,623 to BROTZ discloses an illuminated clipboard having a transparent body with a light-emitting, light-diffusing upper surface and a curved bottom surface wherein the bottom surface curves upward at its sides to meet the top surface with a light source disposed within the transparent body of the clipboard to reflect light off the curved bottom which causes the light within the transparent body of the clipboard to be reflected off the bottom surface to the light-emitting, light-diffusing upper surface to illuminate what is positioned on the light-emitting, light-diffusing upper surface of the clipboard. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 5,654,552 to TOOMBS discloses a glow-in-the-dark lamp shade that includes a glow-in-the-dark region with a first side disposed toward a light source so that the light source illuminates the first side and with a second side disposed away from the light source. The glow-in-the-dark region includes aglow-in-the-dark substance that stores energy for illumination and that responds to the stored energy by emitting light in the visible range. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 5,752,761 to PIETRUCZYNIK discloses a high visibility flashlight body having a luminescent outer surface on the main body and closure cap. The outer surface includes a luminescent colorant composition in the base material, being distributed throughout the thickness of the main body. This prior art patent also teaches that the fluorescent colorants can be in either the outer layer or incorporated into the substrate layer of the main body of the flashlight. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. No. 5,882,239 to TRICHAK discloses an illuminatable plastic disc that spins and flies when thrown that include chemiluminescent composition passages that extend radially across substantially the entire disc so when the disc spins in darkness, the entire disc appears illuminated. The chemiluminescent passages are formed integrally with the disc. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

U.S. Pat. Nos. 5,450,173 and 5,898,508 to BERANICH discloses a portable duplicating device which may be used with any commercially available photocopy machine to provide two-dimensional copies of two or three dimensional objects. This duplicating device includes a luminescent box for illuminating the inside of the box for providing two-dimensional reproductions of two or three-dimensional objects. This prior art patent does not disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

None of these prior art patents disclose or teach a container, receptacle or box having luminosity, being a luminescent coating thereon, for emergency or non-lighted conditions in which to illuminate the surfaces of such containers, and give them visibility in the absence of any light source; and wherein the luminescent coating has a protective material coating thereon to prevent the luminescent coating from wearing-off.

Accordingly, it is an object of the present invention to provide a receptacle, container, kit and the like having luminescent surfaces thereon for providing and producing a bright light source in order to locate these receptacles, containers and the like in absence of any type of light source for non-lighted and emergency conditions.

Another object of the present invention is to provide a receptacle, container, kit and the like that include luminescent surfaces having a coating made from luminescent chemical materials selected from the group consisting of white phosphorous, red phosphorous, phosphors, organic guanines (fish scales), metallic and non-metallic micas, bismuth oxychloride, phosphorous oxychloride, or other chemiluminescent materials.

Another object of the present invention is to provide a receptacle, container, kit and the like that produces a light source from a luminescent material which glows white, red, yellow or green in the absence of light.

Another object of the present invention is to provide a chemiluminescent coating to the outer surface and/or inner surface of receptacles, containers, kits and the like in order to illuminate and give them visibility when no visible light is present.

Another object of the present invention is to provide a chemiluminescent coating to such receptacles, containers, kits and the like that include first-aid kits, survival food containers, flashlight holders, tool boxes, gasoline containers, kerosine lanterns, propane canisters/lanterns, canteens, portable water bottles/holders, generators, camping stoves/burners, and the like.

Another object of the present invention is to provide luminescent outer surfaces to such aforementioned receptacles, containers, kits and the like in order to give visible light source to such hardware and emergency-type devices in an interior or exterior area having a minimum or complete absence of light.

Another object of the present invention is to provide receptacles, containers, kits and the like that includes a micro-thin screen cover having a color tint, in which to enhance the luminescent outer surfaces of such devices in order for the chemiluminescent material coating to be better observed by the user in the absence of any other light source.

Another object of the present invention is to provide receptacles, containers, kits and the like that includes a transparent protective cover for protecting the luminescent material coating on the outer surfaces of the aforementioned devices from wearing off or deteriorate through normal use and handling.

Another object of the present invention is to provide receptacles, containers, kits and the like that include luminescent outer surfaces having a chemiluminescent coating or coatings that are long-lasting, durable in use, and reliable for producing a light source in the absence of light.

Another object of the present invention is to provide receptacles, containers, kits and the like that include luminescent material coatings being in the form of strips, stripes, geometric shapes, non-geometric shapes, indicia, animal shapes, floral shapes, non-lineal patterns and the like.

Another object of the present invention to provide receptacles, containers, kits and the like that include luminescent material coatings being applied to materials of construction such as wood, metal, plastic, ceramic, corrugated cardboard, ply-wood, and the like.

A further object of the present invention to provide receptacles, containers, kits and the like that includes a chemiluminescent coating on the outer surface of such aforementioned devices where such luminescent material coating may be mass produced in an automated and economical manner on such devices and is readily affordable by the consumer.

SUMMARY OF THE INVENTION

In accordance with the present invention, there is provided a container or receptacle having luminosity for emergency or non-lighted conditions to illuminate the surfaces of such containers or receptacles in which to give them visibility in the absence of any light source. The container includes an upper lid section and a lower retaining section having an interior compartment for holding of materials, goods, products, tools, medical equipment or medicine therein. The upper lid section includes interior lid wall surfaces and exterior lid wall surfaces, and the lower retaining section includes interior retaining wall surfaces and exterior retaining wall surfaces. The interior lid wall surfaces and/or the exterior lid surfaces includes a luminescent coating thereon for providing luminosity and for affording visibility to the upper lid section in the absence of any other light source. The interior retaining wall surfaces and/or the exterior retaining wall surfaces includes a luminescent coating thereon for providing luminosity and for affording visibility to the lower retaining section in the absence of any other light source. The luminescent coating includes protective covering means for allowing an increased visibility of the luminescent coating, and for giving resistance to wear and impact of the luminescent coating on the wall surfaces of the container.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

GLOSSARY OF COMPONENT PARTS

Figure 1:
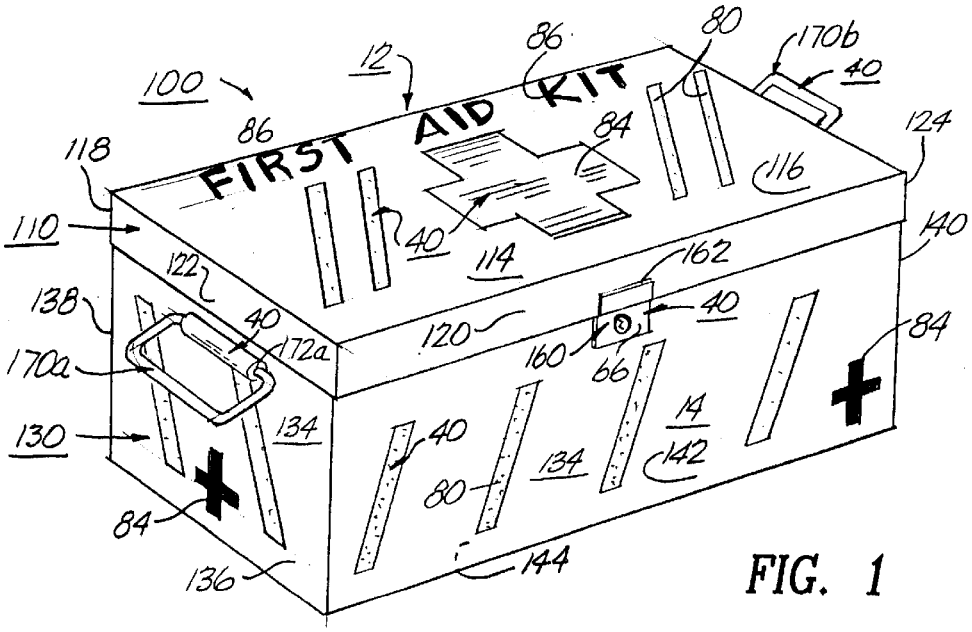
FIG. 1 is a front perspective view of the first-aid kit having chemiluminescent coatings thereon of the first alternate embodiment of the present invention showing the outer exterior surfaces of the first-aid kit having luminescent markings, indicia, and stripes thereon.

| Part No. | Description of the Component Parts |
|---|---|
| 10 | |
| 12 | A First Aid Kit |
| 14 | An Emergency Tool Box |
| 16 | A Food Rations Container |
| 18 | An Equipment Tool Chest |
| 20 | A Water Holder |
| 22 | A Propane Lantern |
| 40 | A Luminescent Coating Having |
| 42 | Adhesive Components Therein for Adhering to Either |
| 112/132 | The Interior Wall Surfaces and/or |
| 114/134 | The Exterior Wall Surfaces |
| 48 | Protective Covering Means Include |
| 50 | A Plastic Non-Porous and Transparent Covering |
| 52 | Having An Interior Covering Wall Surface and |
| 54 | An Exterior Covering Wall Surface |
| 60 | A Plastic Micro-Thin Covering Having |
| 62 | Raised Ridged Surface Elements Thereon and Having |
| 64 | A Plurality of Micro-Hole Openings Therein and Having |
| 66 | An Interior Covering Wall Surface |
| 68 | An Exterior Covering Wall Surface |
| 70 | A Protective Covering Laminate Having |
| 72 } 50 | An Outer Layer Being Plastic Covering |
| 74 } 60 | An Inner Layer Being A Plastic Micro-Thin Covering |
| 100 | A Container in the Form of |
| 12 | A First Aid Kit Including |

-continued

| Part No. | Description of the Component Parts |
|---|---|
| 110 | A Lid Section Having |
| 112 | Interior Lid Wall Surfaces, and |
| 114 | Exterior Lid Wall Surfaces |
| 116 | A Top Lid Wall |
| 118 | A Back Lid Wall |
| 120 | A Front Lid Wall And |
| 122 } 124 | Side Lid Walls |
| 130 | A Retaining Section Having |
| 132 | Interior Retaining Wall Surfaces, and |
| 134 | Exterior Retaining Wall Surfaces |
| 136 } 138 | Having Side Walls |
| 140 } 142 | |
| 144 | A Bottom Wall |
| 146 | For Forming An Interior Compartment |
| 150 | A Hinge Member Having |
| 152 | An Upper Hinging Section and |
| 154 | A Lower Hinging Section Being Attached By |
| 156 | Rivets or Screws |
| 160 | A Latching Member Having |
| 162 | An Upper Latch Section With |
| 164 | A Latch Opening Therein and |
| 166 | A Lower Latch Section With A |
| 168 | Latch Tab Member Thereon (Latch Opening is Used for Receiving the Latch Tab Member Therein) |
| 170a and 170b | A Pair of Handle Members |
| 172a and 172b | Having a Hinging Member Thereon |
| 174a and 174b | With a Plurality of Mounting Openings Therein For Receiving Rivets or Screws 156 Thereon |
| 40 | A Luminescent Coating Having |
| 42 | Adhesive Components Therefor for Adhering to Either |
| 112/132 | The Interior Wall Surfaces and/or |
| 114/134 | The Exterior Wall Surfaces |
| 200 | A Receptacle of the Second Alternate Embodiment Being |
| 14 | An Emergency Tool Box |
| 300 | A Canister of the Third Alternate Embodiment Being |
| 16 | A Survival Food Container |
| 312 | Outer Perimeter Side Wall of Lid Section |
| 332 | Outer Perimeter Side Wall of Retaining Section |
| 400 | A Box of the Fourth Alternate Embodiment Being |
| 18 | An Equipment Tool Chest |
| 440 | A Compartmented Drawer Having |
| 442 | An Interior Drawer Surface and |
| 444 | An Exterior Drawer Surface |
| 500 | A Jug of the Fifth Alternate Embodiment Being |
| 20 | A Water Holder |
| 530 | A Pour Spout |
| 540 | A Carrying Handle |
| 600 | A Metal Bottle of the Sixth Alternate Embodiment Being |
| 22 | A Propane Lantern |
| 630 | A Glass Light Shell |
| 640 | A Metal Shade |
| 642 | Exterior Wall Surface of the Retaining Section |

DETAILED DESCRIPTION OF THE ALTERNATE EMBODIMENTS

OVERVIEW

The receptacles and containers 100, 200, 300, 400, 500 and 600 and their component parts of the alternate embodiments of the present invention are represented in detail by FIGS. 1 through 16 of the patent drawings. The containers 100, 200, 300, 400 and 500 include luminosity 40 for emergency or non-lighted conditions in which to illuminate the outer surfaces and/or interior surfaces of such containers, give them visibility in the absence of any light source. These containers can be in the form of a receiving receptacle with a lid/cover, as shown in embodiments 100, 200, 300 and 400; or the containers can be in the form of the retaining section only, as shown in embodiments 500 and 600.

The containers having the chemiluminescent coatings 40 thereon can be in the form of receptacles, containers, kits and the like that include first-aid kits, survival food containers, flashlight holders, tool boxes, gasoline containers, kerosine lanterns, propane canisters/lanterns, canteens, portable water bottles/holders, generators, camping stoves/burners, and the like. These aforementioned receptacles, containers, kits and the like have the luminescent material coatings 40 being applied to materials of construction such as wood, metal, plastic, ceramic, corrugated cardboard, plywood, and the like.

Figure 15:
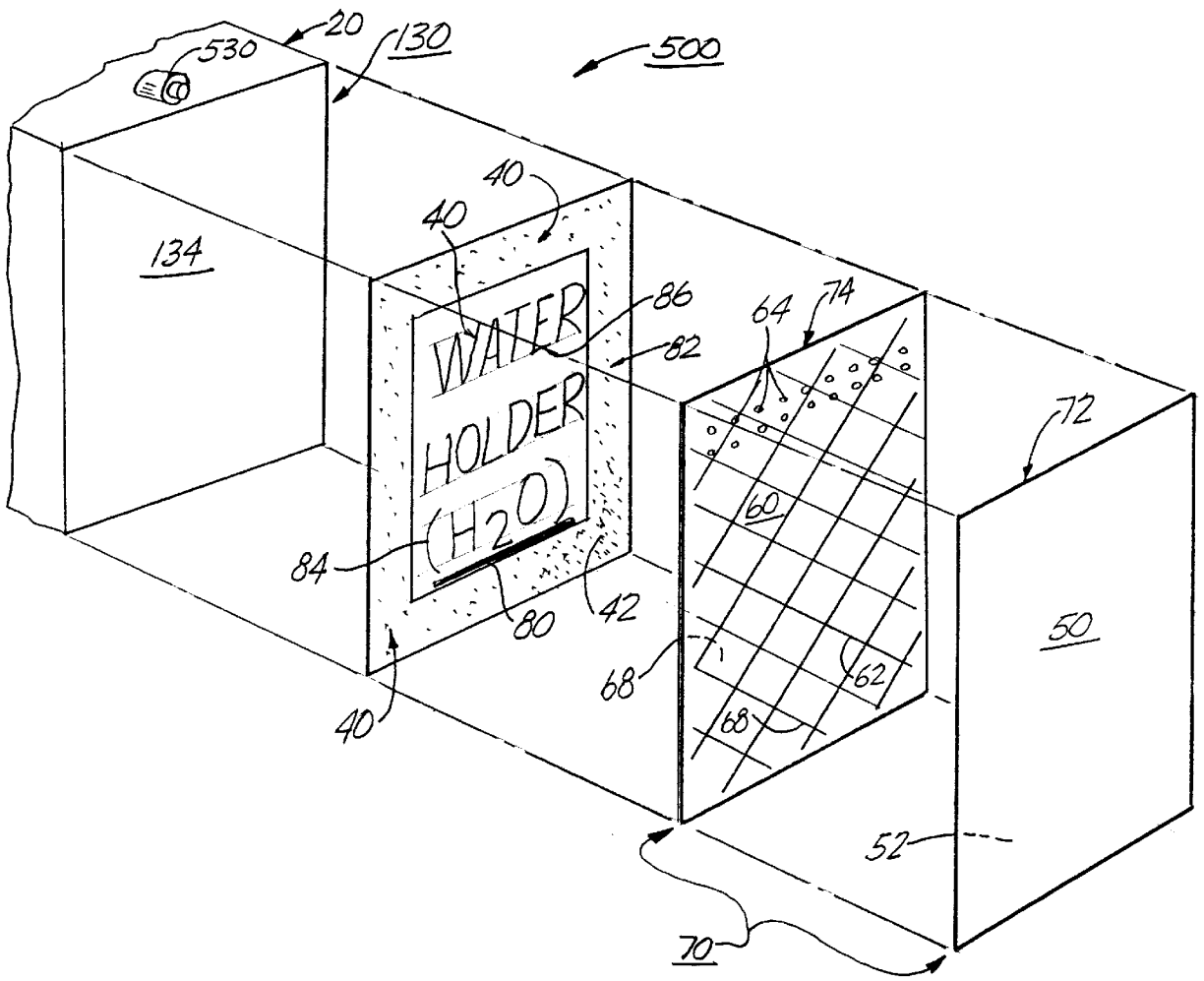
FIG. 15 is an exploded front perspective view of the emergency water holder having chemiluminescent coatings thereon of the fifth alternate embodiment of the present invention showing the laminate structure of the holder front wall having luminescent coatings thereon being protected by a two-ply protective covering laminate having an inner layer of a porous and raised ridged surface plastic covering and having an outer layer of a non-porous and transparent plastic covering.
Figure 16:
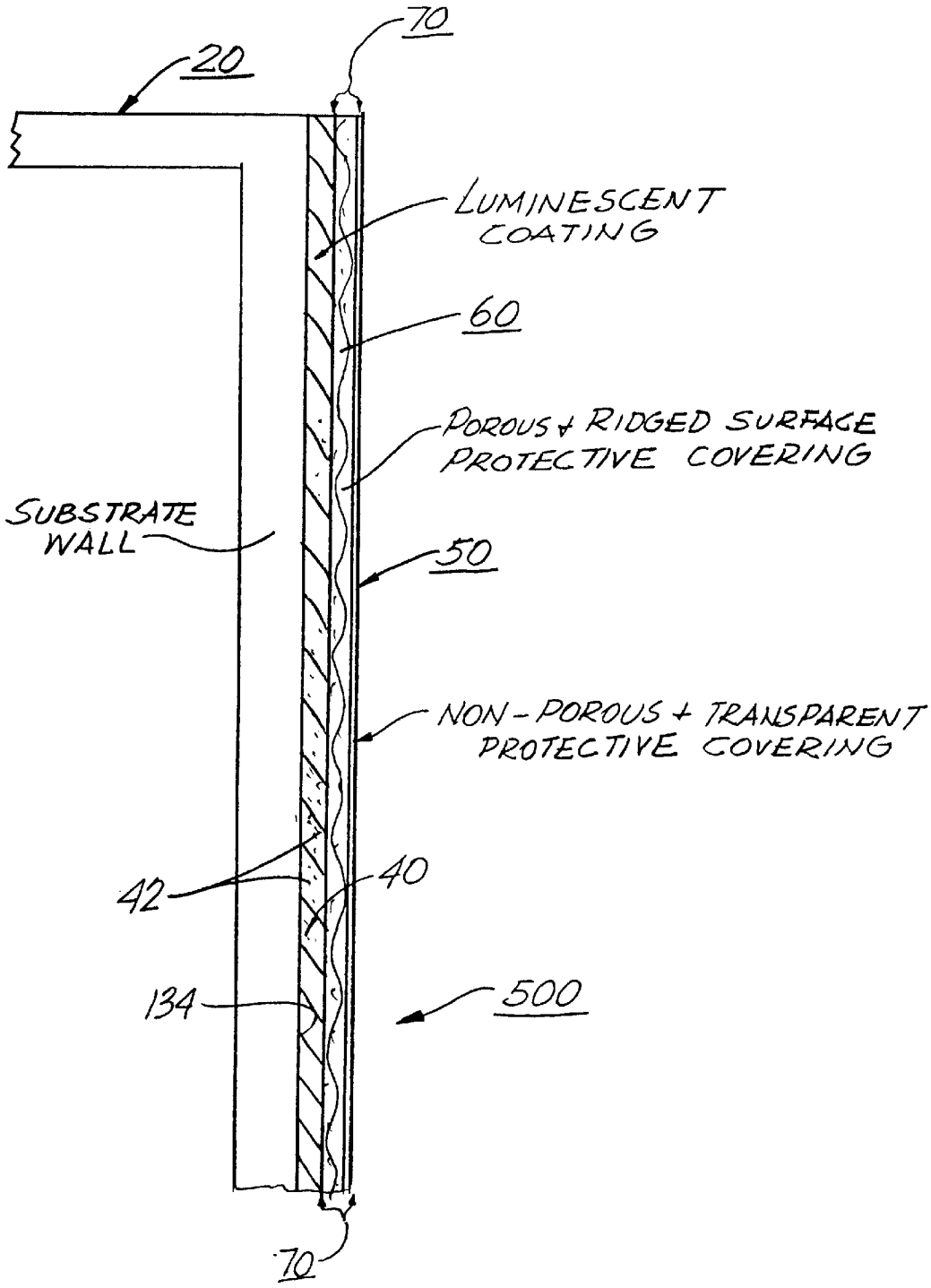
FIG. 16 is an enlarged cross-sectional view of the emergency water holder having chemiluminescent coatings thereon of the fifth alternate embodiment taken along lines 16—16 of FIG. 11 showing the holder front wall, the luminescent coating and the two-ply protective covering laminate being attached and adhesive thereto.

The luminescent material coating 40 includes protective coating means 48 for protecting the luminescent material coating 40 on the outer and/or inner wall surfaces of the aforementioned containers from wearing-off or deteriorating through normal use and handling. The protective coating means 48 can be a single outer covering layer including a non-porous and transparent plastic covering 50 having an interior covering wall surface 52 and an exterior wall surface 54; or a plastic micro-thin covering 60 having raised ridged surface elements 62 thereon and having a plurality of micro-hole openings 64 therein, and having an interior covering wall surface 66 and an exterior covering wall surface 68, as shown in FIGS. 3, 6, 13 and 14 of the patent drawings. Alternatively, the protective coating means 48 can be a composite laminate outer covering layer including a protective covering laminate 70 having an outer layer 72 being the plastic covering 50 and an inner layer 74 being the plastic micro-thin covering 60, as shown in FIGS. 15 and 16 of the patent drawings.

The luminescent material coating 40 further includes adhesive components 42 therein for adhering to either interior wall surfaces and/or exterior wall surfaces. The luminescent material coatings 40 are made from luminescent chemical materials or chemical compounds selected from the group consisting of white phosphorous, red phosphorous, phosphors, organic guanines (fish scales), metallic and non-metallic micas, bismuth oxychloride, phosphorous oxychloride, or other chemiluminescent materials. Additionally, the luminescent material coatings 40 on the wall surfaces of the receptacles, containers or kits can have configurations, designs or shapes being in the form of strips, stripes, geometric shapes, non-geometric shapes, indicia, animal shapes, floral shapes, non-lineal patterns and the like, as shown in FIGS. 1, 2, 4, 5, 7 and 13 of the patent drawings.

FIRST ALTERNATE EMBODIMENT 100

Figure 2:
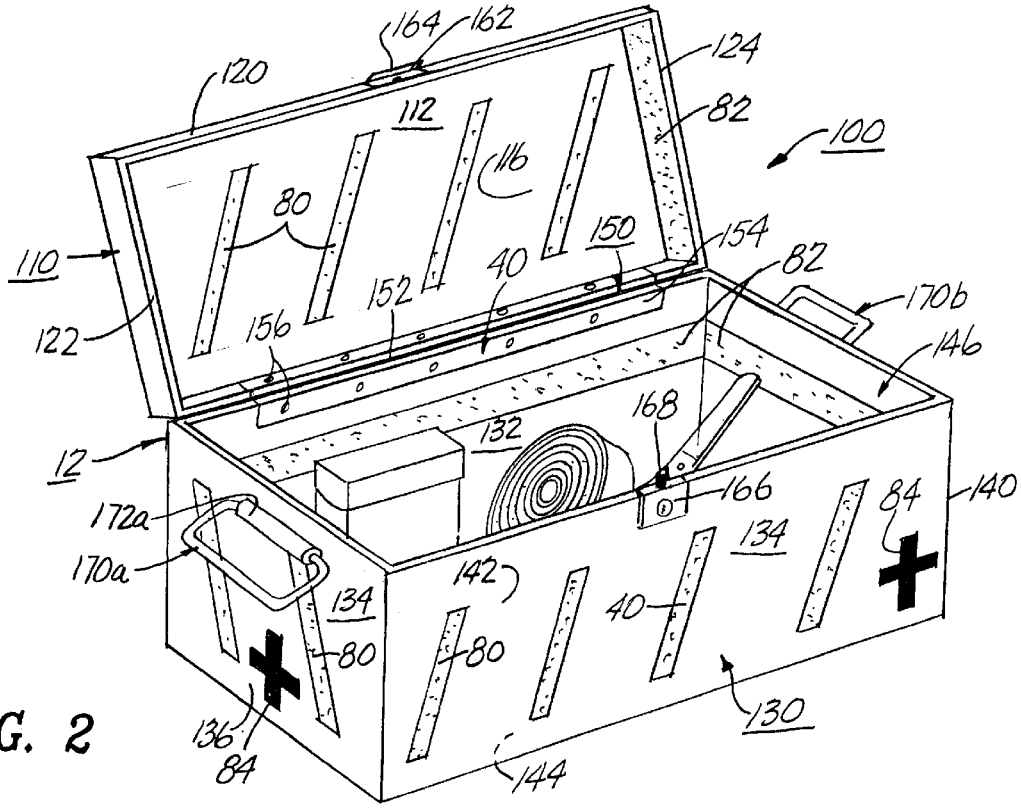
FIG. 2 is a front perspective view of the first-aid kit having chemiluminescent coatings thereon of the first alternate embodiment showing the inner interior surfaces of the first-aid kit having luminescent markings, indicia and strips thereon and with the lid in an opened position.

The container 100 and its component parts of the first alternate embodiment of the present invention are represented in detail by FIGS. 1, 2, 3 and 13 of the patent drawings. Container 100 is in the form of a first aid kit 12 containing typical medical supplies, as shown in FIG. 2. The first aid kit 12 of the first alternate embodiment 100 includes a lid section 110 and a retaining section 130 made of a light-weight metal. The lid section 110 includes interior lid wall surfaces 112 and exterior lid wall surfaces 114. Further, the lid section 110 also includes a top lid wall 116, a back lid wall 118, a front lid wall 120 and side lid walls 122 and 124, respectively. The retaining section 130 includes interior retaining wall surfaces 132 and exterior retaining wall surfaces 134. Further, the retaining section 130 includes side walls 136, 138, 140 and 142 and a bottom wall 144 for forming an interior compartment 146. The lid section 110 and the retaining section 130 are joined together by a hinge member 150 having an upper hinging section 152 and a lower hinging section 154 being attached by rivets or screws 156 to the lid and retaining sections 110 and 130, respectively. Additionally, the lid section 110 and the retaining section 130 can be closed together by a latching member 160 having an upper latch section 162 with a latch opening 164 therein. The upper latch section 162 is centrally located on the front lid wall 120. The latching member 160 also having a lower latch section 166 with a latch tab member 168 thereon, wherein the latch tab member 168 is received within the latch opening 164 of the upper latch section 162. The lower latch section 166 is centrally located on the front wall 142 of the retaining section 130; and is adjacent and aligned with the upper latch section 162, as shown in FIGS. 1 and 2 of the drawings. Additionally, side walls 136 and 140 include handle members 170*a* and 170*b*, respectively, thereon. Each of the handle members 170*a* and 170*b* include a hinging member 172*a* and 172*b* thereon having a plurality of mounting openings 174*a* and 174*b* therein for receiving rivets or screws 156 therethrough.

Figure 3:
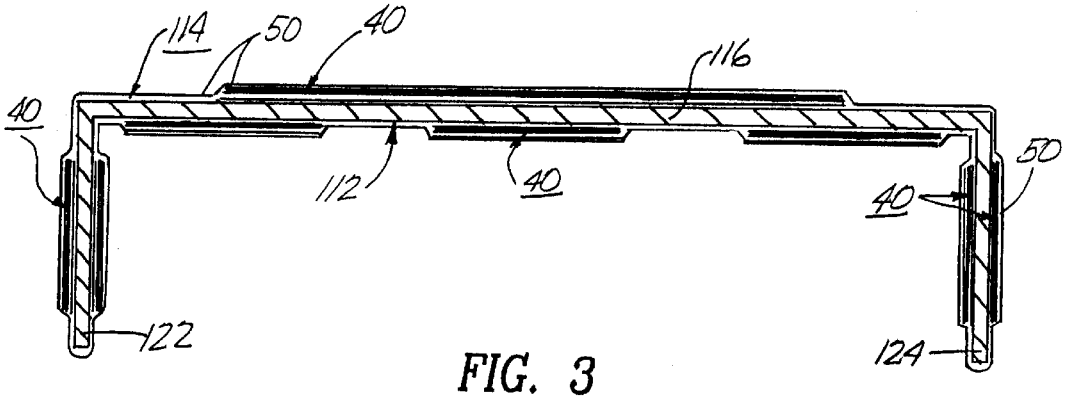
FIG. 3 is an enlarged cross-sectional view of the first-aid kit having chemiluminescent coatings thereon of the first alternate embodiment of the present invention taken along lines 3—3 of FIG. 1 showing the luminescent coatings on the exterior and interior wall surfaces of the lid section.
Figure 4:
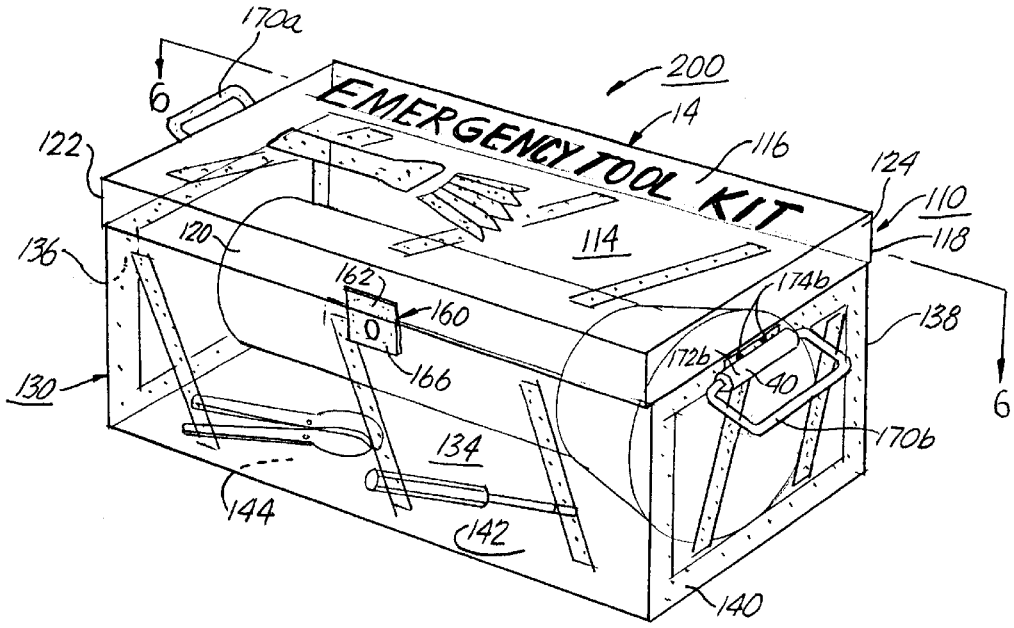
FIG. 4 is a front perspective view of the emergency tool box having chemiluminescent coatings thereon of the second alternate embodiment of the present invention showing the transparent walls of the emergency tool box having the interior wall surfaces with luminescent markings, indicia and stripes thereon.
Figure 5:
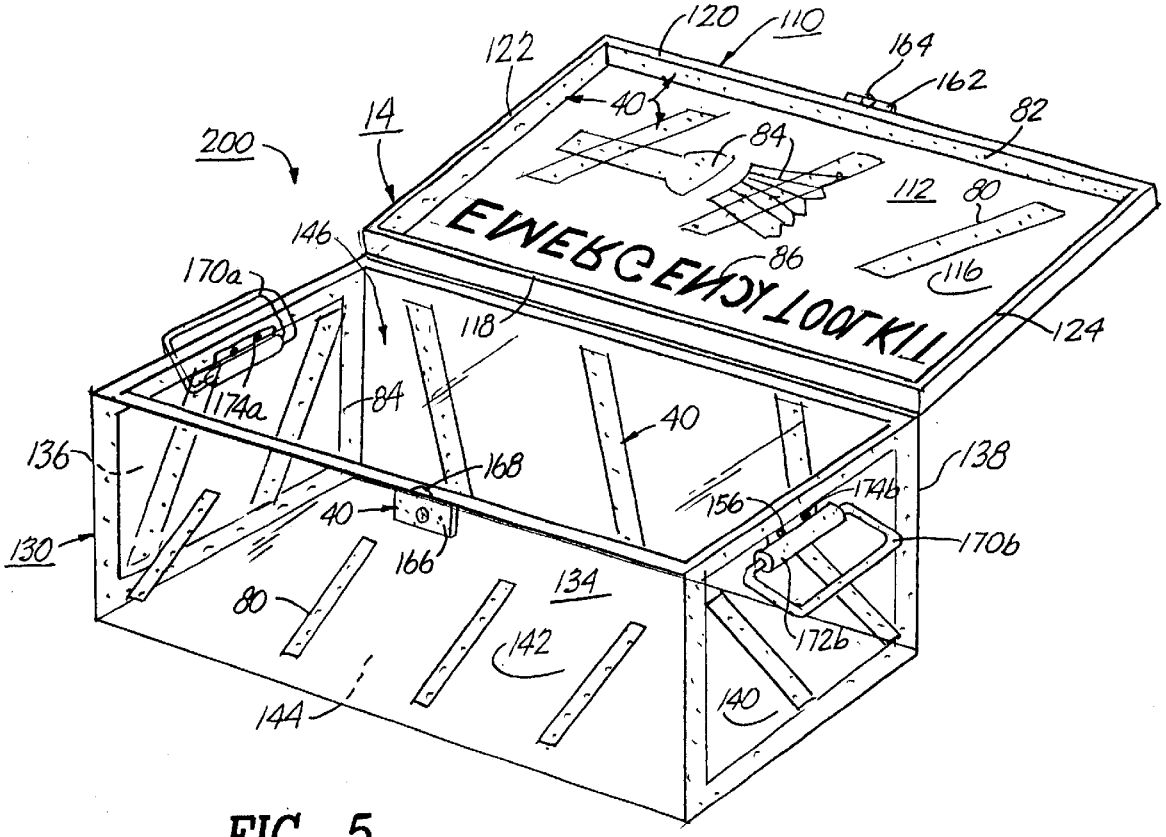
FIG. 5 is a front perspective view of the emergency tool box having chemiluminescent coatings thereon of the second alternate embodiment of the present invention showing the transparent walls of the emergency tool box having the interior wall surfaces with luminescent markings, indicia and strips thereon and having the lid in an opened position.
Figure 13:
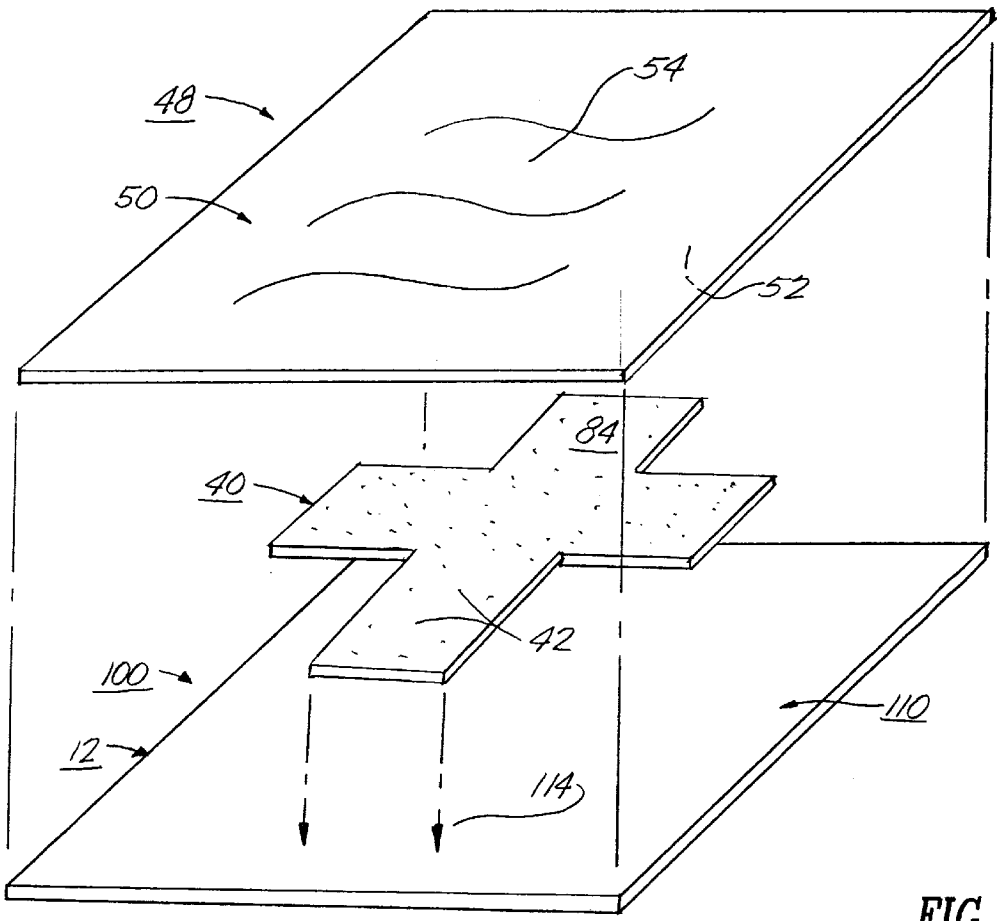
FIG. 13 is an exploded front perspective view of the first-aid kit having chemiluminescent coatings thereon of the first alternate embodiment of the present invention showing the laminate structure of the container top wall having the luminescent coating thereon being protected by a non-porous and transparent plastic covering.

As shown in FIGS. 1, 2 and 3 of the drawings, the luminescent coating 40 is applied to the interior lid wall surfaces 112 and to the exterior lid wall surfaces 114 in the form of stripes 80, strips 82, a geometric shape 84 (a red cross), and indicia markings 86 (i. e. "FIRST AID KIT"). The luminescent coating 40 is also applied to the interior retaining wall surfaces 132 and to the exterior retaining wall surfaces 134 in the form of stripes 80, strips 82, and geometric shapes 84 (red crosses). These luminescent coatings 40 are protected from wear and deterioration through normal use and handling by the use of plastic non-porous and transparent coverings 50, as shown in FIGS. 3 and 13 of the patent drawings. The interior covering wall surface 52 of plastic covering 50 is in contact and adhered to both of the luminescent coatings 40, as well as the wall surfaces 112, 114, 132 and 134 in which to protect the luminescent coatings 40. Additionally, the hinge member 150, the latching member 160 and handle members 170*a* and 170*b* also include luminescent coatings 40 having the plastic coverings 50 thereon.

SECOND ALTERNATE EMBODIMENT 200

Figure 6:
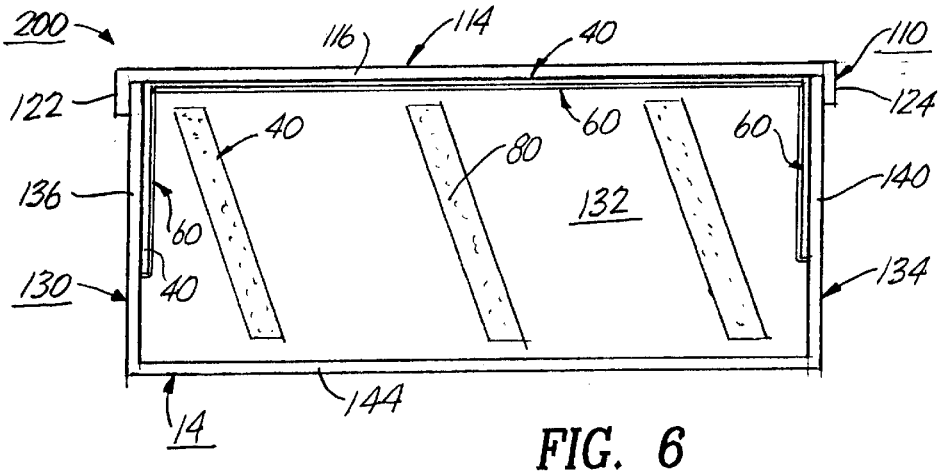
FIG. 6 is an enlarged cross-sectional view of the emergency tool box having chemiluminescent coatings thereon of the second alternate embodiment of the present invention taken along lines 6—6 of FIG. 4 showing the interior wall surfaces of both of the lid and retaining sections thereof.
Figure 14:
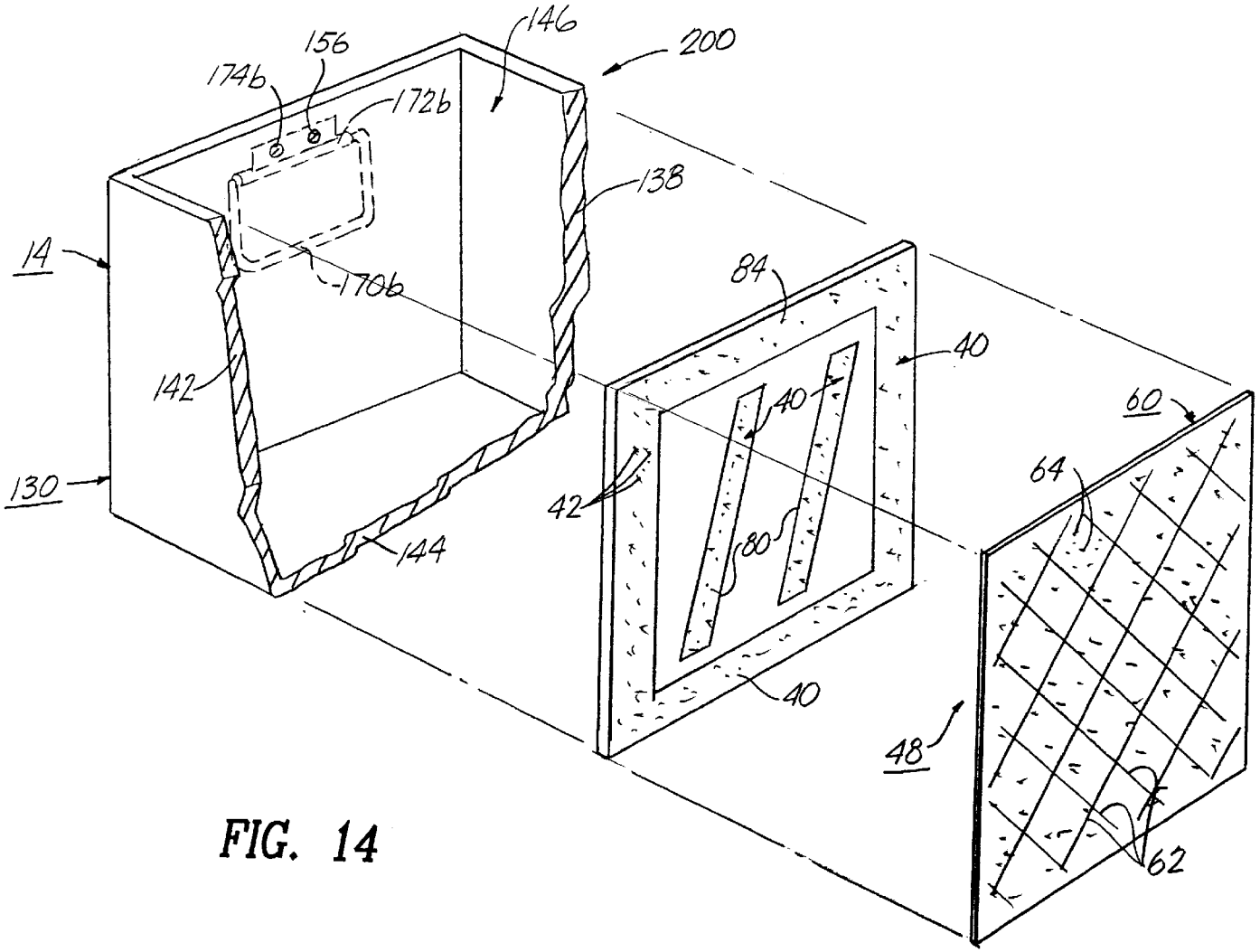
FIG. 14 is an exploded rear perspective view of the emergency tool box having chemiluminescent coatings thereon of the second alternate embodiment of the present invention showing the laminate structure of the box side wall having the luminescent coating thereon being protected by a plastic micro-thin covering having a raised ridged surface and having a plurality of micro-hole openings therein.

The receptacle 200 and its component parts of the second alternate embodiment of the present invention are represented in detail by FIGS. 4, 5, 6 and 14 of the patent drawings. Receptacle 200 is in the form of an emergency tool box 14 containing typical emergency tools such as a flashlight, a plyer, a screw driver and the like, as shown in FIG. 1. Emergency tool box 14 of the second alternate embodiment 200 is similar in structure of the first alternate embodiment 100 except the lid section 110 and the retaining section 130 are made of clear and transparent plastic materials. Additionally, as shown in FIGS. 6 and 14 of the drawings, the luminescent coatings 40 are only applied to the interior lid wall surfaces 112 of the lid section 110 and the interior retaining wall surfaces 132 of the retaining section 130. As the walls 116, 118, 120, 122, 124, 136, 138, 140 and 142 are transparent and the luminescent coatings 40 need only be applied to the interior lid or retaining wall surfaces 112 or 132 for visibility of the chemiluminescent materials on the emergency tool box 14 in the absence of any light. The luminescent coatings on these interior wall surfaces 112 and 132 are in the form of stripes 80, strips 82, geometric shapes 84, non-geometric shapes 88, and indicia markings 86 and the like. In this second alternate embodiment 200, the luminescent coatings 40 are protected from wear and deterioration through normal use and handling by the use of a clear and transparent plastic micro-thin covering 60 having raised ridged surface elements 62 thereon and having a plurality of micro-hole openings 64 therein for enabling oxygen ($O_2$) to transfer and come in contact with the chemiluminescent materials in order to afford the emergency tool box 14 visibility. In all other aspects, the second alternate embodiment 200 functions the same as the first alternate embodiment 100 in the use of luminescent coatings 40 on such receptacles or containers.

THIRD ALTERNATE EMBODIMENT 300

Figure 8:
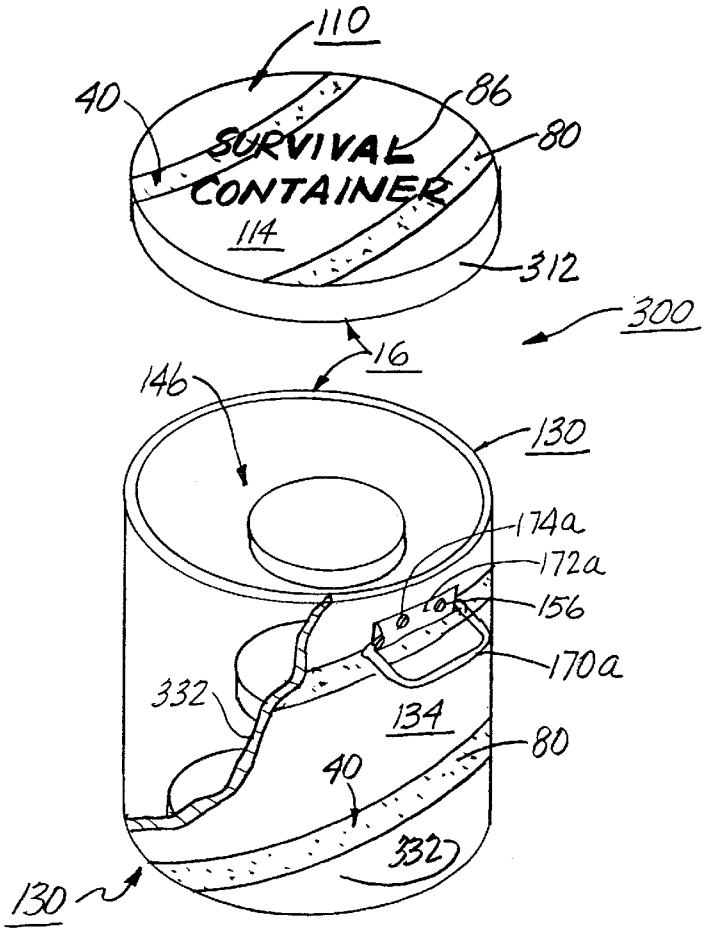
FIG. 8 is an exploded perspective view of the survival food container thereon of the third alternate embodiment of the present invention showing the inner interior surfaces of the lid section and retaining section of the survival food container having luminescent markings, indicia and strips thereon and having the lid section in an unscrewed configuration.
Figure 7:
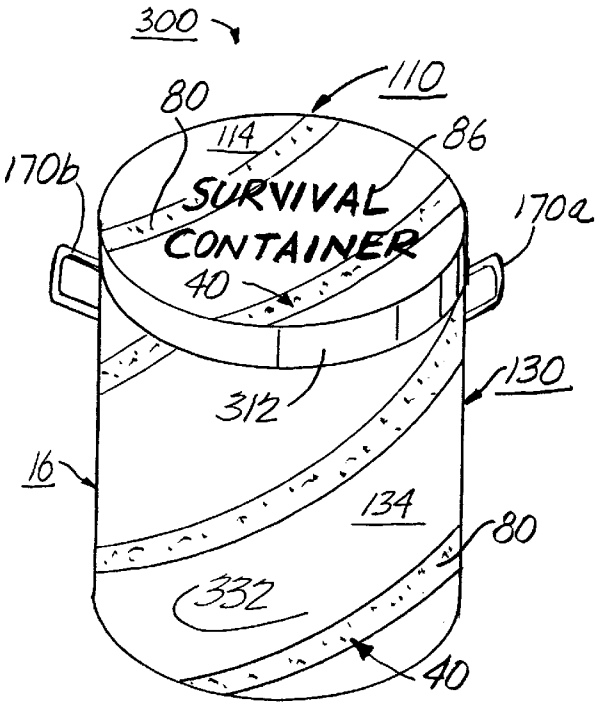
FIG. 7 is a perspective view of the survival food container having chemiluminescent coatings thereon of the third alternate embodiment of the present invention showing the outer exterior surfaces of the survival food container having luminescent markings; indicia and strips thereon.

The canister 300 and its component parts of the third alternate embodiment of the present invention are represented in detail by FIGS. 7 and 8 of the patent drawings. Canister 300 is in the form of a survival food container 16 containing typical dried food rations for emergency conditions, as shown in FIG. 8. All aspects of the third alternate embodiment 300 of the survival food container 16 are the same as the first alternate embodiment 100 of the first aid kit 12 except for the shape and configuration of lid section 110 and retaining section 130 being cylindrically shaped and also the outer perimeter side wall 312 of lid section 110 and the outer perimeter side wall 332 of retaining section 130 are curved in shape, respectively. The luminescent coatings 40 are in the form of a spiral stripes 80 and indicia markings 86 on the exterior wall surfaces 114 and 134 of the lid section 110 and retaining section 130, respectively. In all other aspects, the survival food container 16 of the third alternate embodiment 300 is similar in structure and operable exactly as the first alternate embodiment 100 of first aid kit 12 of the present invention.

FOURTH ALTERNATE EMBODIMENT 400

Figure 9:
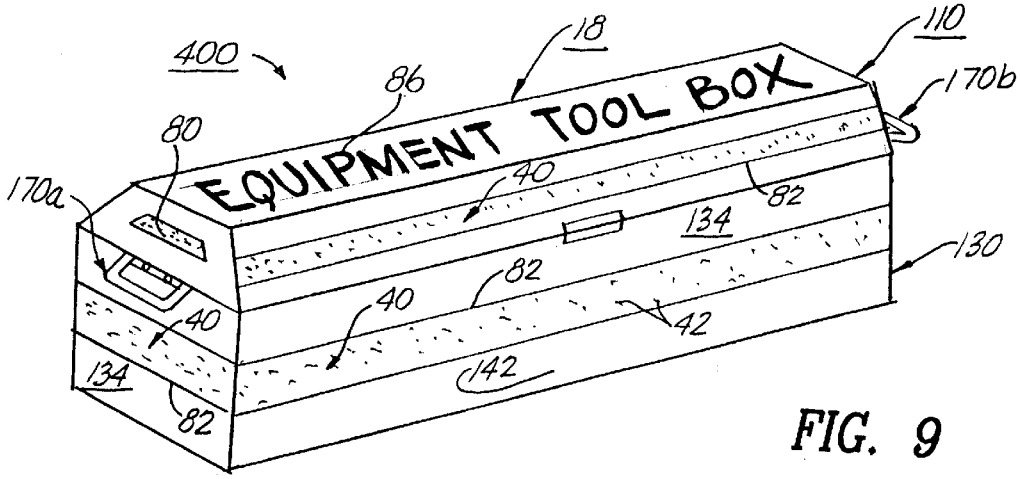
FIG. 9 is a front perspective view of the equipment tool box having chemiluminescent coatings thereon of the fourth alternate embodiment of the present invention showing the outer exterior surfaces of equipment tool box having luminescent markings, indicia and geometrically-shaped patches thereon.
Figure 10:
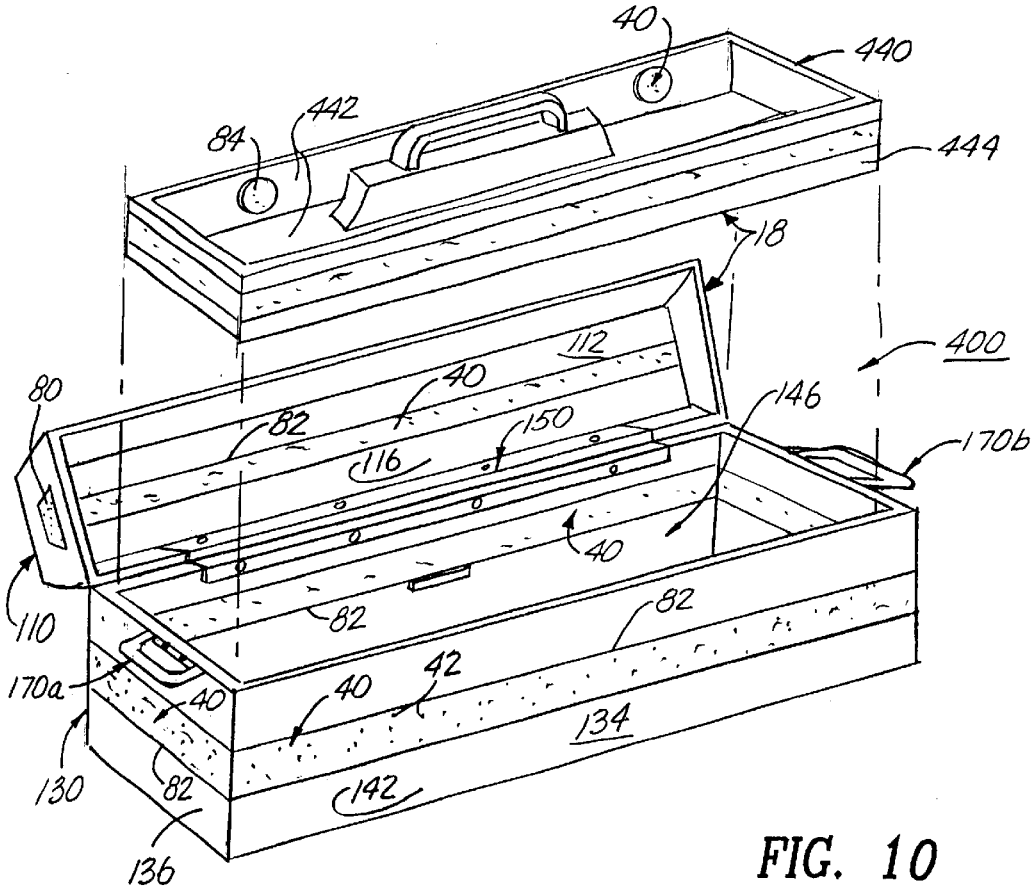
FIG. 10 is an exploded perspective view of the equipment tool box having chemiluminescent coatings thereon of the fourth alternate embodiment of the present invention showing the inner interior surfaces of the lid section, the inner holding tray and the retaining receptacle section having luminescent markings, indicia and stripes thereon and having the lid section in an opened position.

The box 400 and its component parts of the fourth alternate embodiment of the present invention are represented in detail by FIGS. 9 and 10 of the patent drawings. Box 400 is in the form of an equipment tool chest 18 containing standard-type tools therein for use during emergency conditions, as shown in FIG. 10. All aspects of the fourth alternate embodiment 400 of the equipment tool chest 18 are the same as the first alternate embodiment 100 of the first aid kit 12 except for the shape and configuration of the lid section 110, and the retaining section 130 having a compartmented drawer 440 therein. The luminescent coatings 40 are in the form of stripes 80, strips 82, geometric shapes 84, and indicia markings 86 on the interior and exterior wall surfaces 112, 114, 132 and 134 of the lid section 110, the retaining section 130 and the compartmented drawer surfaces 442 and 444 of drawer 440, respectively. In all other aspects, the equipment tool chest 18 of the fourth alternate embodiment 400 is similar in structure and is operable exactly as the first alternate embodiment 100 of the first aid kit 12 of the present invention.

FIFTH ALTERNATE EMBODIMENT 500

Figure 11:
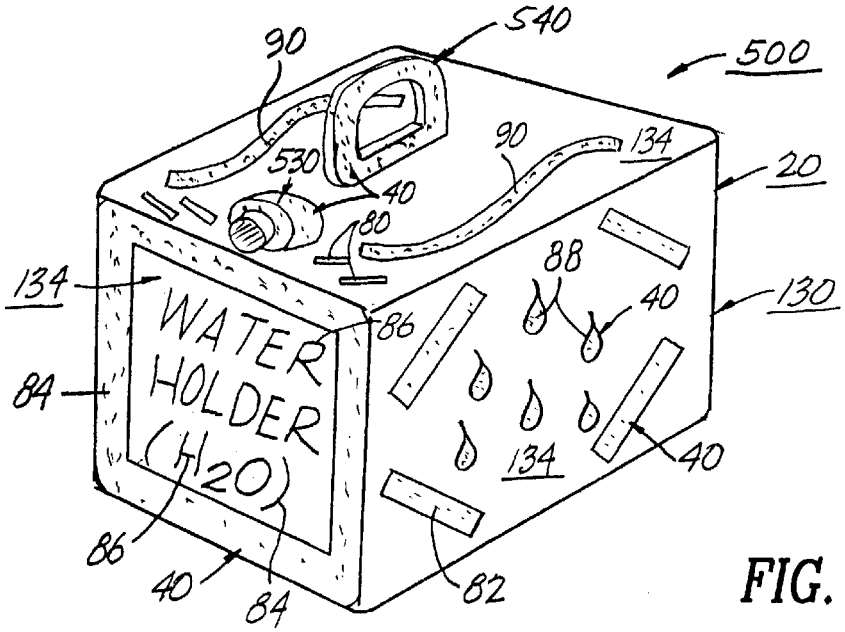
FIG. 11 is a front perspective view of the emergency water holder having chemiluminescent coatings thereon of the fifth alternate embodiment of the present invention showing outer exterior surfaces of the water holder having luminescent markings, indicia and stripes thereon.

The jug 500 and its component parts of the fifth alternate embodiment of the present invention are represented in detail by FIGS. 11, 15 and 16 of the patent drawings. Jug 500 is in the form of a water holder 20 for holding purified water therein for emergency conditions. All aspects of the fifth alternate embodiment 500 of the water holder 20 are the same as the emergency tool box 14 of the second alternate embodiment 200 except for the shape and configuration of the retaining section 130 having a pour spout 530 and carrying handle 540 thereon. The luminescent coatings 40 are in the form of stripes 80, strips 82, geometric shapes 84, non-geometric shapes 88, indicia markings 86, and non-lineal patterns 90 on the exterior wall surfaces 134 of the water holder 20, as shown in FIG. 11 of the drawings.

Additionally, these luminescent coatings 40 are protected from wear and handling by the use of a protective covering laminate 70, as depicted in FIGS. 15 and 16 of the drawings. The protective covering laminate 70 covers all of the luminescent coatings 40 on the exterior wall surfaces 134. In all other aspects, the water holder 20 of the fifth alternate embodiment 500 is similar in structure and is operable exactly as the second alternate embodiment 200 of the emergency tool box 14 of the present invention.

SIXTH ALTERNATE EMBODIMENT 600

Figure 12:
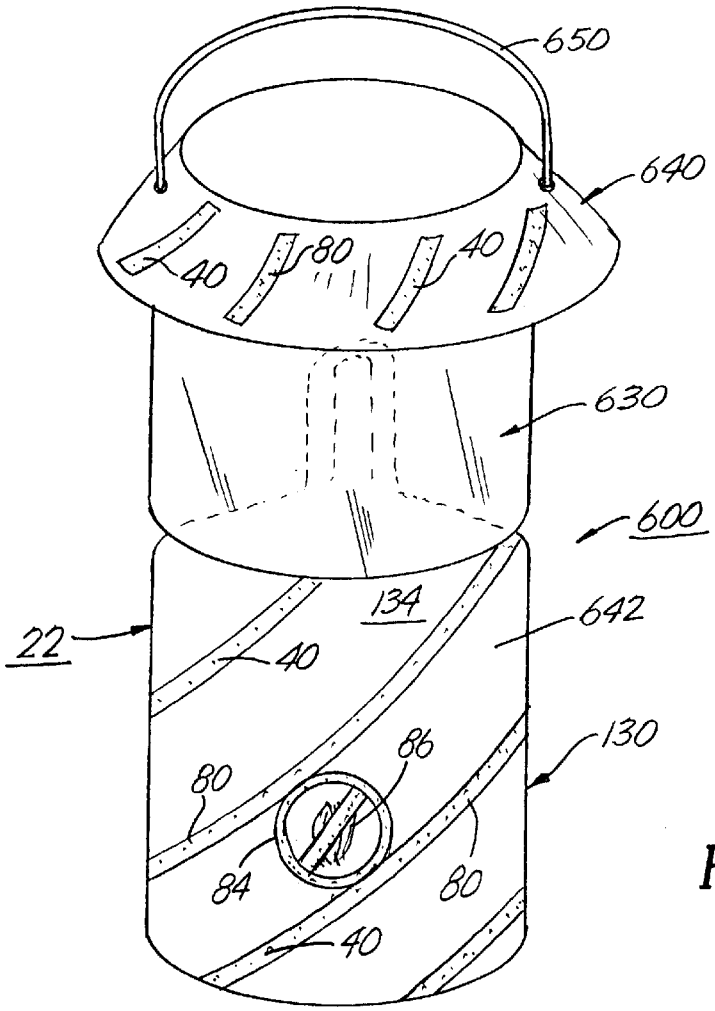
FIG. 12 is a perspective view of the propane lantern having chemiluminescent coatings thereon of the sixth alternate embodiment of the present invention showing the outer exterior surfaces of the propane canister and the lantern shade having luminescent markings, indicia and stripes thereon.

The metal bottle 600 and its component parts of the sixth alternate embodiment of the present inventio is represented in detail by FIG. 12 of the patent drawings. Metal bottle 600 is in the form of propane lantern 22 for providing light in emergency or non-lighted conditions. All aspects of the sixth alternate embodiment 600 of the propane lantern 22 are the same as the third alternate embodiment 300 of the survival food container 16 except for the shape and configuration of the retaining section 130, the glass light shell 630, the metal shade 640 having a carrying handle 650. The luminescent coatings 40 are in the form of spiral stripes 80, geometric shapes 84 and indicia markings 86 on the exterior wall surfaces 134 and 642 of the propane lantern 22, as depicted in FIG. 12 of the drawings. In all other aspects, the propane lantern 22 of the sixth alternate embodiment 600 is similar in structure and is operable exactly as the third alternate embodiment 300 of the survival food container 16 of the present invention.

ADVANTAGES OF THE PRESENT INVENTION

Accordingly, an advantage of the present invention is that it provides for a receptacle, container, kit and the like having luminescent surfaces thereon for providing and producing a bright light source in order to locate these receptacles, containers and the like in absence of any type of light source for non-lighted and emergency conditions.

Another advantage of the present invention is that it provides for a receptacle, container, kit and the like that include luminescent surfaces having a coating made from luminescent chemical materials selected from the group consisting of white phosphorous, red phosphorous, phosphors, organic guanines (fish scales), metallic and non-metallic micas, bismuth oxychloride, phosphorous oxychloride, or other chemiluminescent materials.

Another advantage of the present invention is that it provides for a receptacle, container, kit and the like that produces a light source from a luminescent material which glows white, red, yellow or green in the absence of light.

Another advantage of the present invention is that it provides for a chemiluminescent coating to the outer surface and/or inner surface of receptacles, containers, kits and the like in order to illuminate and give them visibility when no visible light is present.

Another advantage of the present invention is that it provides for a chemiluminescent coating to such receptacles, containers, kits and the like that include first-aid kits, survival food containers, flashlight holders, tool boxes, gasoline containers, kerosine lanterns, propane canisters/ lanterns, canteens, portable water bottles/holders, generators, camping stoves/burners, and the like.

Another advantage of the present invention is that it provides for luminescent outer surfaces to such aforementioned receptacles, containers, kits and the like in order to give visible light source to such hardware and emergency-type devices in an interior or exterior area having a minimum or complete absence of light.

Another advantage of the present invention is that it provides for receptacles, containers, kits and the like that includes a micro-thin screen cover having a color tint, in which to enhance the luminescent outer surfaces of such devices in order for the chemiluminescent material coating to be better observed by the user in the absence of any other light source.

Another advantage of the present invention is that it provides for receptacles, containers, kits and the like that includes a transparent protective cover for protecting the luminescent material coating on the outer surfaces of the aforementioned devices from wearing off or deteriorate through normal use and handling.

Another advantage of the present invention is that it provides for receptacles, containers, kits and the like that include luminescent outer surfaces having a chemiluminescent coating or coatings that are long-lasting, durable in use, and reliable for producing a light source in the absence of light.

Another advantage of the present invention is that it provides for receptacles, containers, kits and the like that include luminescent material coatings being in the form of strips, stripes, geometric shapes, non-geometric shapes, indicia, animal shapes, floral shapes, non-lineal patterns and the like.

Another advantage of the present invention is that it provides for receptacles, containers, kits and the like that include luminescent material coatings being applied to materials of construction such as wood, metal, plastic, ceramic, corrugated cardboard, ply-wood, and the like.

A further advantage of the present invention is that it provides for receptacles, containers, kits and the like that includes a chemiluminescent coating on the outer surface of such aforementioned devices where such luminescent material coating may be mass produced in an automated and economical manner on such devices and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A container having luminosity for emergency or non-lighted conditions to illuminate the surfaces of such containers in which to give them visibility in the absence of any light source, comprising:

a) A container including an upper lid section and a lower retaining section having an interior compartment for holding of materials, goods, products, tools, medical equipment and optionally medicine therein;

b) said upper lid section including interior lid wall surfaces and exterior lid wall surfaces, and said lower retaining section including interior retaining wall surfaces and exterior retaining wall surfaces;

c) at least one of said interior lid wall surfaces and said exterior lid wall surfaces including a luminescent coating thereon for providing luminosity and for affording visibility to said upper lid section in the absence of any other light source;

d) at least one of said interior retaining wall surfaces and said exterior retaining lid wall surfaces including a luminescent coating thereon for providing luminosity and for affording visibility to said lower retaining section in the absence of any other light source; and e) protective covering means for allowing an increased visibility of said luminescent coating, and for giving resistance to wear and impact of said luminescent coating on said wall surfaces of said container, a container having luminosity wherein said protective covering means includes a plastic micro-thin covering having raised and ridged surface elements thereon and a plurality of micro-hole openings for the transfer of oxygen ($O_2$) through said micro-hole openings in order to increase the visibility of said luminescent coatings on said wall surfaces of said container.

2. A container having luminosity in accordance with claim 1, wherein said protective covering means includes a non-porous and transparent plastic covering.

3. A container having luminosity in accordance with claim 2, wherein said non-porous and transparent plastic covering has a wall thickness in the range of 2 mils to 5 mils.

4. A container having luminosity in accordance with claim 1, wherein said protective covering means includes a protective covering laminate.

5. A container having luminosity in accordance with claim 4, wherein said protective covering laminate has a laminate wall thickness in the range of 4 mils to 10 mils.

6. A container having luminosity in accordance with claim 1, wherein said luminescent coating has a coating wall thickness in the range of 5 mils to 20 mils.

7. A container having luminosity in accordance with claim 1, wherein said luminescent coating is in the form of geometric configurations selected from the group consisting of stripes, strips, crosses, squares, stars, circles, ovals, rectangles, trapezoid, and other polygonal shapes.

8. A container having luminosity in accordance with claim 1, wherein said luminescent coating is in the form of a non-geometric configurations selected from the group consisting of indicia, logos, trademarks, animals, insects, fish, cartoon characters, flowers, wild life and other non-linear and curved shapes.

9. A container having luminosity in accordance with claim 1, wherein said luminescent coating is a light source made from luminescent chemical materials selected from the group consisting of white phosphorous, red phosphorous, phosphors, organic guanines (fish scales), metallic and non-metaillic micas, bismuth oxychloride, phosphorous oxychloride, and other luminescent materials.

10. A container having luminosity in accordance with claim 9, wherein said luminescent chemical material producing said light source includes a glowing color selected from the group consisting of white, red, yellow and green.

11. A container having luminosity in accordance with claim 1, wherein said container further includes accessories in the form of handles, latches, hinges, trays, interior compartments, drawers, switches, and the like.

12. A container having luminosity in accordance with claim 11, wherein said accessories include said luminescent coating having said protective covering means thereon.

13. A container having luminosity in accordance with claim 1, wherein said container made from a moldable material selected from the group consisting of rigid plastics, cardboard, glass, ceramics and lightweight metals material.

14. A container having luminosity in accordance with claim 13, wherein said plastics and said glass are at least one of transparent, translucent and colored.

15. A container having luminosity for emergency or non-lighted conditions to illuminate the surfaces of such containers in which to give them visibility in the absence of any other light source, comprising:

a) a container including an upper lid section and a lower retaining section having an interior compartment for holding of materials, goods, products, tools, medical equipment and optionally medicine therein;

b) said upper lid section including interior lid wall surfaces and exterior lid wall surfaces, and said lower retaining section including interior retaining wall surfaces and exterior retaining wall surfaces;

c) said interior lid wall surfaces and said exterior lid wall surfaces including a luminescent coating thereon for providing luminosity and for affording visibility to said upper lid wall section in the absence of any other light source; and d) protective covering means for allowing an increased visibility of said luminescent coating, and for giving resistance to wear and impact of said luminescent coating on said wall surfaces of said container, a container having luminosity wherein said protective covering means includes a plastic micro-thin covering having raised and ridged surface elements thereon and a plurality of micro-hole openings for the transfer of oxygen ($O_2$) through said micro-hole openings in order to increase the visibility of said luminescent coatings on said wall surfaces of said container.

16. A container having luminosity for emergency or non-lighted conditions to illuminate the surfaces of such containers or receptacles in which to give them visibility in the absence of any other light source, comprising:

a) a container including an upper lid section and a lower retaining section having an interior compartment for holding materials, goods, products, tools, medical equipment and optionally medicine therein;

b) said upper lid section including interior lid wall surfaces and exterior lid wall surfaces, and said lower retaining section including interior retaining wall surfaces and exterior retaining wall surfaces;

c) said interior retaining wall surfaces and said exterior retaining wall surfaces including a luminescent coating thereon for providing luminosity and for affording visibility to said lower retaining section in the absence of any other light source; and d) protective covering means for allowing an increased visibility of said luminescent coating, and for giving resistance to wear and impact of said luminescent coating on said wall surfaces of said container, a container having luminosity wherein said protective covering means includes a plastic micro-thin covering having raised and ridged surface elements thereon and a plurality of micro-hole openings for the transfer of oxygen ($O_2$) through said micro-openings in order increase the visibility of said luminescent coatings on said wall surfaces of said container.

17. A container having luminosity for emergency or non-lighted conditions to illuminate the surfaces of such containers in which to give them visibility in the absence of any other light source, comprising:

a) a container, including a lower retaining section having an interior compartment for holding of materials, goods, products, tools, medical equipment and optionally medicine therein;

b) said lower retaining section including interior retaining wall surfaces and exterior retaining wall surfaces;

c) said interior retaining wall surfaces and said exterior retaining wall surfaces including a luminescent coating thereon for providing luminosity and for affording visibility to said lower retaining section in the absence of any other light source; and d) protective covering means for allowing an increased visibility of said luminescent coating, and for giving resistance to wear and impact of said luminescent coating on said wall surfaces of said container, a container having luminosity wherein said protective covering means includes a plastic micro-thin covering having raised and ridged surface elements thereon and a plurality of micro-hole openings for the transfer of oxygen ($O_2$) through said micro-hole openings in order to increase the visibility of said luminescent coatings on said wall surfaces of said container.

* * * * *